US005525056A

United States Patent [19]

Sutton

[11] Patent Number: 5,525,056

[45] Date of Patent: Jun. 11, 1996

[54] FUEL FIRED BURNERS

[75] Inventor: David M. Sutton, Camberley, United Kingdom

[73] Assignee: British Gas plc, London, England

[21] Appl. No.: 107,996

[22] Filed: Aug. 18, 1993

[30] Foreign Application Priority Data

Aug. 18, 1992 [GB] United Kingdom ..... 9217539

[51] Int. Cl.[6] ..... F23D 14/16

[52] U.S. Cl. ..... 431/328; 431/114; 431/286

[58] Field of Search ..... 431/114, 346, 431/326, 328, 329, 286, 7, 170; 126/91 AC, 92 B, 92 C

[56] References Cited

U.S. PATENT DOCUMENTS

| | | | |
|---|---|---|---|
| 2,480,658 | 8/1949 | Jones | 431/114 X |
| 3,245,458 | 4/1966 | Patrick et al. | 126/92 BX |
| 3,254,964 | 6/1966 | Lehrer et al. | 431/114 X |
| 3,258,058 | 6/1966 | LHerault et al. | 431/329 |
| 3,277,948 | 10/1966 | Best . | |
| 3,302,689 | 2/1967 | Milligan | 431/328 |
| 5,249,953 | 10/1993 | Roth | 431/328 X |

FOREIGN PATENT DOCUMENTS

| | | | |
|---|---|---|---|
| 924233 | 4/1973 | Canada | 431/328 |
| 0311462 | 4/1989 | European Pat. Off. . | |
| 0381252 | 8/1990 | European Pat. Off. . | |
| 1120491 | 7/1968 | United Kingdom . | |
| 1266201 | 3/1972 | United Kingdom . | |
| 2056045 | 3/1981 | United Kingdom . | |
| 2176588 | 12/1986 | United Kingdom . | |
| 2226398 | 6/1990 | United Kingdom . | |

*Primary Examiner*- Carl D. Price
*Attorney, Agent, or Firm*- Oblon, Spivak, McClelland, Maier & Neustadt

[57] ABSTRACT

A fuel fired burner comprises a chamber for receiving a premixture of fuel and air. A wall of the chamber is in the form of a flamestrip provided with a plurality of elongate slots extending through the wall. Each slot has an inlet portion which converges to an end leading to a substantially constant dimension portion. The pitch of the slots along the chamber wall is P, the width of each slot is w, and the length of the constant dimension portion is L. The dimensions of the flamestrip are arranged such that $L/w \geqq 10$ and $P/w \geqq 2$. A burner including such an arrangement reduces the likelihood of resonant combustion noise being generated when enclosed within a heating appliance.

8 Claims, 4 Drawing Sheets

FUEL FIRED BURNERS

FIELD OF THE INVENTION

The present invention relates to a fuel fired burner, and particularly a gas-fired burner, which preferably is of the fully premixed type i.e. one in which the fuel gas is mixed with all the combustion air in a mixing chamber before the gas is combusted.

One type of fully premixed burner comprises a plenum chamber into which an externally prepared mixture of air and fuel gas, such as natural gas, is introduced before being discharged more or less uniformly through ports in a block, plate or strip which may or may not form a part or wall of the chamber. The mixture is combusted at a point within or downstream of the block, plate or strip, to produce combustion products which then enter a first enclosure leading to a second enclosure such as a heat exchanger when the burner is used as a heat source in a heating appliance, such as a boiler. A typical fully premixed burner is described in our published UK Patent Application No. 2176588A.

A problem with burners of this type is that there is a tendency under certain conditions for them to generate unacceptable intensities of so-called resonant combustion noise, particularly when enclosed in a heating appliance and when the burner is operated at a relatively high heat output per unit of burner surface area.

SUMMARY OF THE INVENTION

An object of the present invention is to alleviate or reduce the likelihood of resonant combustion noise being generated in burners of the fully premixed type when they are enclosed as described above.

To this end, the invention provides a fuel fired burner comprising a chamber for receiving a premixture of fuel and air, a wall of the chamber being provided with a plurality of elongate slots extending through the wall, each slot having an inlet portion which converges to an end leading to a substantially constant dimension portion; wherein the pitch of the slots along the chamber wall is P, the width of each slot is w, and the length of the constant dimension portion is L; and wherein $L/w \geqq 10$ and $P/w \geqq 2$.

The significance of L/w being equal to or greater than 10 is that this allows the flow through the slot to be substantially fully developed in an aerodynamic sense. As a result there is a boundary layer close to the wall of the slot in which the velocity of flow is very low and this assists in maintaining a stable flame at the outlet of the slot.

The significance of P/w being equal to or greater than 2 is that this enables good flame stability to be achieved without an attendant risk of flame light-back through the slot. In addition, for the same reason and also, by reducing the percentage open area in the slotted wall, it improves the resistance of the burner to generating resonant combustion noise.

The length of the inlet portion is denoted by l and it is preferred that $L \geqq l$ because this maximises L for given thickness (L+l) of slotted wall. Also, it minimizes the volume of the convergent zone of the slot, thereby lessening the susceptibility of the burner to combustion resonance.

The angle of convergence of the converging inlet portion may be substantially constant, that is each side wall may be substantially straight or flat.

Alternatively, each converging inlet may have a varying angle of convergence. Preferably, in this case, each side wall of the converging inlet portion is of a convex elliptical curvature as this form avoids a separation of flow occurring at or near the entry of the constant dimension portion of the slot and in addition minimizes the volume of the convergent zone. These features greatly enhance the resistance to resonant combustion.

Each slot may have an outlet portion which diverges away from the end of the constant dimension portion remote from the inlet portion. Applicants investigations have shown that the diverging outlet portion helps to stabilize the flame and thereby reduces the tendency to resonate.

Typically, the width (w) of the constant dimension portion may be in the range from 0.4 to 1.0 mm, and the pitch (P) of the slots may be in the range from 2.5 to 6.0 mm.

In utilizing a burner with the geometry described above it is advantageous to supply the air/gas mixture in a uniformly distributed manner and at a low intensity of flow turbulence. The first of these objectives may be secured by passage of the flow of air/gas mixture through a suitable distribution means of substantial flow resistance located upstream of the inlet portions of the slots. The distribution means may be a perforated plate or, alternatively, a porous plate.

It is further advantageous to provide baffle means having a high acoustic impedance located upstream of the inlet portions of the slots and preferably close to the inlet portions to minimize the volume of the space between the downstream side of the baffle means and such inlet portions. This increases or maximizes the resistance of the burner to the generation of resonant combustion noise for a given flow resistance across the distribution means.

The baffle means may, for example, be a fibrous mat which may be located between a perforated distribution plate, as referred to earlier, and the inlet portions of the slots. Alternatively, and preferably, the porous plate, as referred to earlier, serves not only as the suitable distribution means but also as the baffle means for further improving resistance of the burner to combustion resonance.

BRIEF DESCRIPTION OF THE DRAWINGS

The invention will now be further described, by way of example only, with reference to the accompanying drawings, in which.

DESCRIPTION OF THE PREFERRED EMBODIMENT

Figure 1:
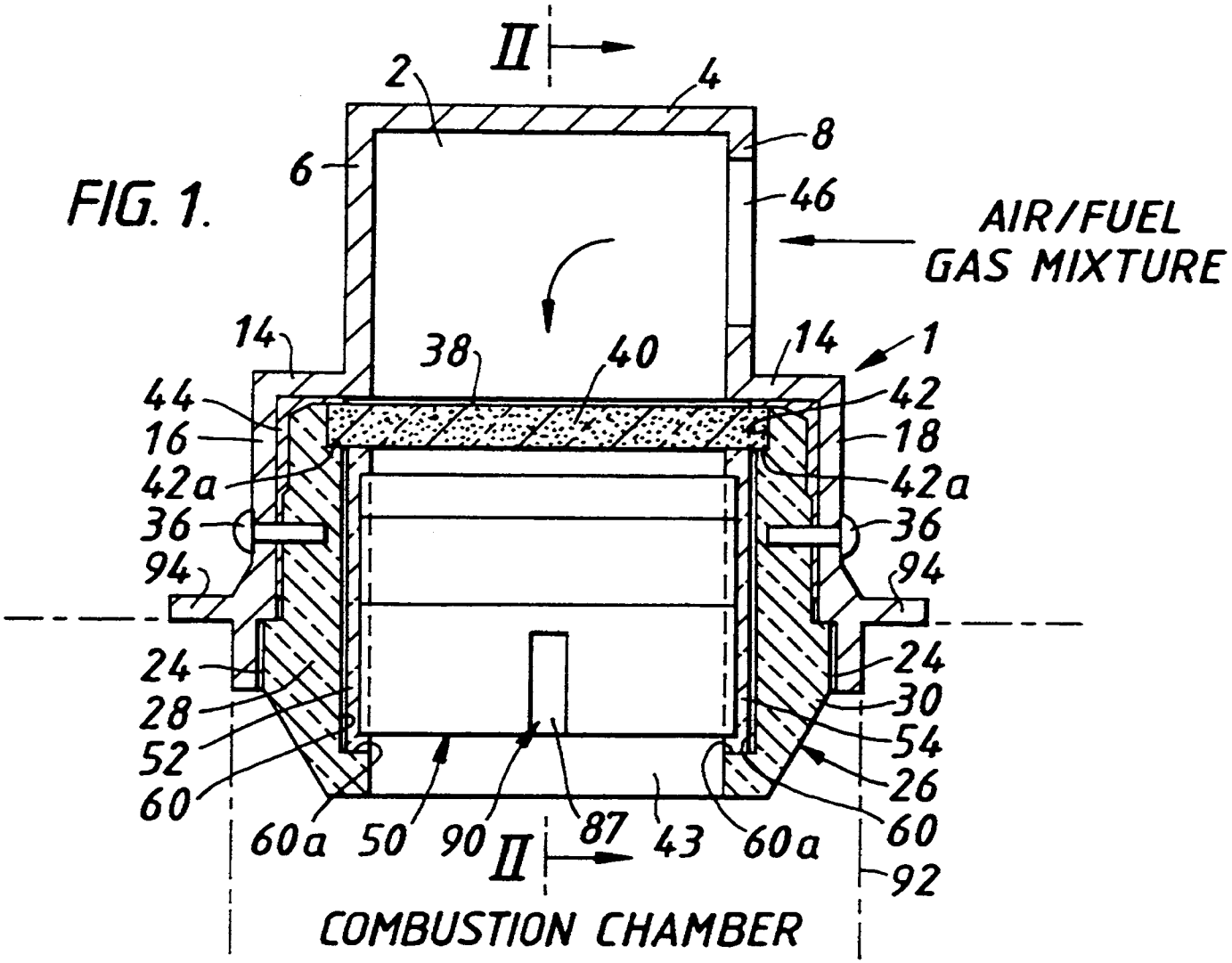
FIG. 1 is a sectional view of one embodiment of burner according to the invention.
Figure 2:
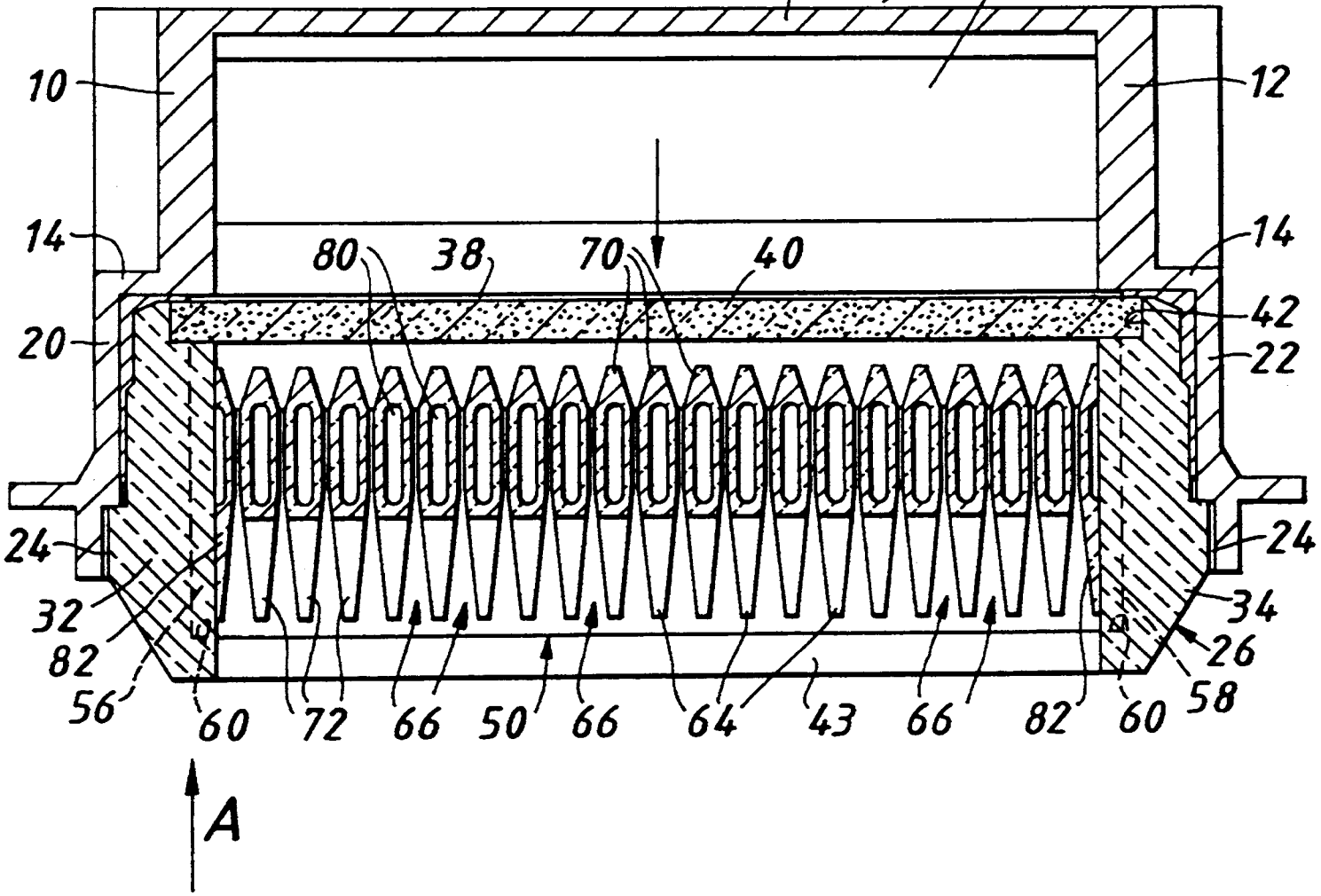
FIG. 2 is a cross-sectional view of the burner taken along line II—II in FIG. 1.

Referring to the drawings, FIGS. 1 and 2 in particular, a gas-fired burner 1 of the fully premixed kind is shown in a downwardly firing mode. The burner 1 comprises an elongated upper chamber serving as a plenum chamber 2 defined in part by a top horizontal wall 4, two vertical side walls 6 and 8, and two vertical end walls 10 and 12. A peripheral wall 14 extends horizontally outwardly from the lower ends of the walls 6,8,10 and 12. From the outer edge of the peripheral wall 14 there extends downwardly two vertical side walls 16 and 18 and two end walls 20 and 22 to form a lower chamber or enclosure which is of generally rectangular cross-section in both the horizontal and vertical planes and which has an opening 24 at the bottom.

A hollow, generally rectangular support member 26 having vertical side walls 28 and 30 and end walls 32 and 34, is mounted within the lower chamber by means of securing pins 36 which extend through the side walls 16 and 18 of the enclosure into the side walls 28 and 30 of the support member 26.

The opening 38 at the top of the support member 26 is closed by a rectangular porous fuel gas/air distribution plate 40 which is supported on a horizontal shoulder portion 42*a* of a recess 42 extending around the inside of the support member. At the bottom of the support member 26 there is an opening 43.

A seal 44 is sandwiched on the one hand between the side and end walls 28,30,32,34 of the support member 26 and the side and end walls 16,18,20,22 of the enclosure, and on the other hand between the upper ends of the side and end walls 16,18,20,22 of the enclosure, and the underside of the peripheral wall 14. As can be seen from FIGS. 1 and 2 the seal 44 is also sandwiched between the upper peripheral edge portions of the distribution plate 40 and the underside of the peripheral wall 14.

The porous distribution plate 40 provides a lower wall to the plenum chamber.

Entry of air/fuel gas premixture to the plenum chamber 2 is via an inlet 46 in the side wall 8 of the chamber 2.

A ceramic flamestrip 50 is also mounted within the lower chamber to provide in effect a wall thereacross. The flamestrip 50 is generally of rectangular shape and comprises side walls 52,54 and end walls 56,58, all of which are located in a recess 60 that extends around the inner periphery of the support member 26 and are held between the shoulder 60*a* of the recess 60 and the underside of the distribution plate 40.

Figure 5:
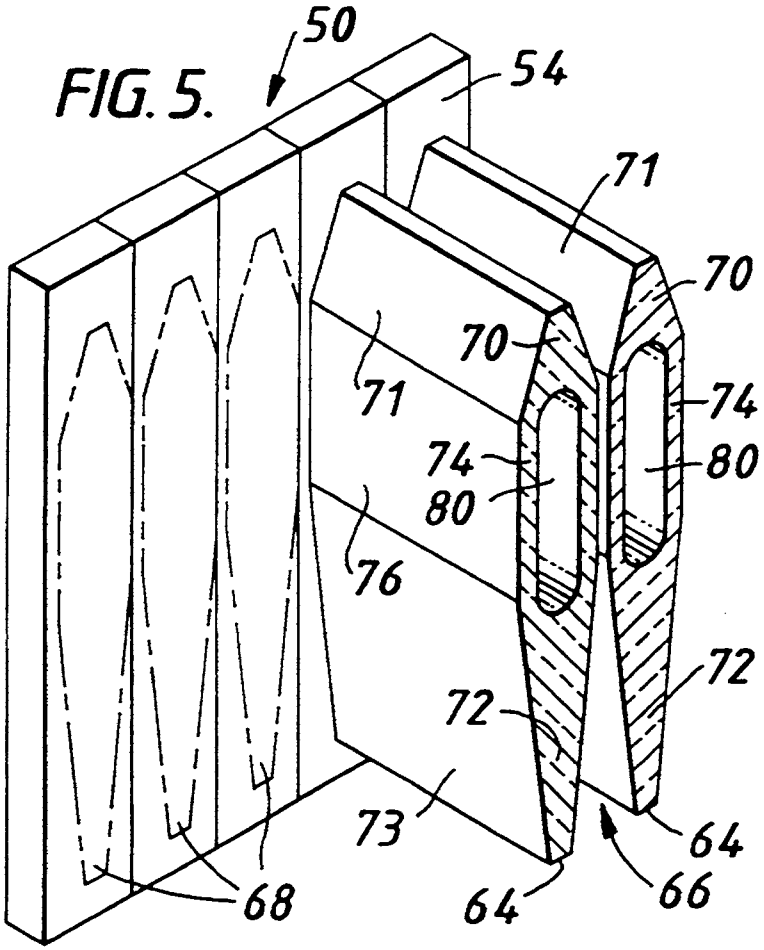
FIG. 5 is a perspective view showing a part of two chamber wall portions defining one of the elongated slots therebetween.
Figure 3:
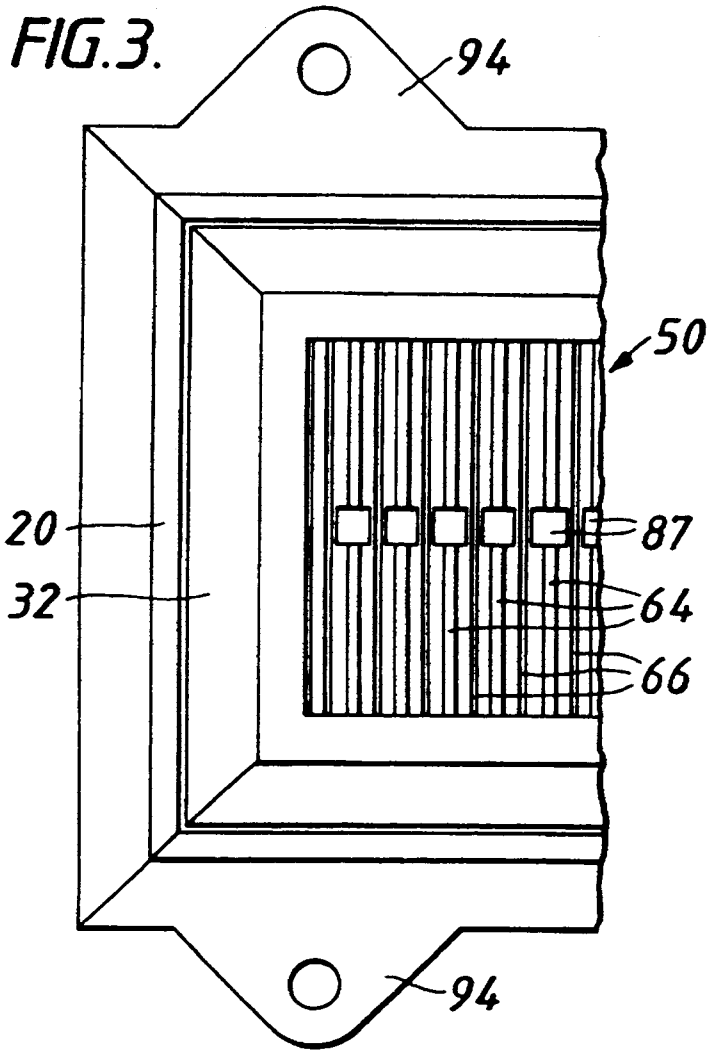
FIG. 3 is a partial view of the burner taken in the direction of arrow A as shown in FIG. 2.

A plurality of equally spaced generally vertical partitions or walls 64 is arranged in a row across the flamestrip 50 between the side walls 52 and 54 parallel to the end walls 56 and 58. Adjacent walls 64, 64 define therebetween a plurality of burner ports in the form of parallel elongate slots 66 that extend generally vertically through the flamestrip. Opposite ends of the partitions or walls 64 are secured in recesses 68 in the side walls 52,54, as illustrated with reference to one of the ends in FIG. 5.

Each wall 64 has an upper tapered portion 70 having flat or straight side surfaces 71 and tapering in an upwardly direction, a lower portion 72 having flat or straight side surfaces 73 and tapering in a downwardly direction, and an intermediate portion 74 having parallel sides as at 76 and 78 A hollow or cavity 80 extends horizontally through the wall 64, primarily in the region of the intermediate portion 74, for the width of the wall 64, i.e. substantially from side wall 52 to side wall 54.

It will be seen from FIGS. 1 and 2 that each end of the row of walls 64 terminates in only a partial wall 82. The plurality of equivalent, equispaced elongate slots 66 is defined between adjacent walls 64, or a wall 64 and adjacent partial wall 82. The slots 66 serve as ports or outlets for fuel gas/air premixture for subsequent ignition as will be described below. Each slot 66 has an inlet portion 84 which is defined between adjacent tapered upper wall portions 70 and converges to an end 84*a* which leads to a substantially constant dimension straight portion 86 between adjacent parallel walls 76,78. An outlet portion 88 diverges from the end 86a of the substantially constant dimension portion 86 remote from the inlet portion 84.

Each lower wall portion 72 of the walls 64 has at its free, lower end a central recess 87 which extends completely through the thickness of the portion over a part of its length and is in alignment with the equivalent recesses 87 in the other wall portions 72 to provide a cross-lighting path 90 across the burner flamestrip 50.

In the ready-for-use condition, the assembly of components described above is mounted on a combustion chamber 92 as shown in chain-dotted lines in FIG. 1 by means of an apertured flange 94 which extends outwardly from and around the walls 16,18,20,22 forming the enclosure.

In use, a premixture of fuel gas (natural gas) and air is supplied byway of the inlet 46 to the plenum chamber 2. The mixture then passes through the porous plate 40 which distributes the mixture uniformly and at a low intensity of turbulence to the slotted burner flamestrip 50. The plate 40 also improves the resistance of the burner to combustion resonance. To maximize this latter characteristic as mentioned earlier it is advantageous for the porous plate to be located as close as possible to the inlet portions 84 of the slots 66. Alternatively, and preferably, the porous plate 40 serves not only as a suitable distribution means, but also as a baffle means for further improving resistance of the burner to combustion resonance.

After passing completely through at least the inlet portion 84 and the substantially constant dimension portion 86 of the slot 66 the air/gas mixture is ignited by ignition means (not shown), for example spark electrodes, so as thereafter to combust steadily, without further assistance from the ignition means, at or downstream of the point 86*a*. The burner fires downwardly through the opening 43 into the combustion chamber 92 with the position of the flame relative to the point 86*a* being dependent upon the composition and rate of flow of the air/gas mixture through the flamestrip. Rapid ignition across the lower face of the burner flamestrip 50 is facilitated by the provision of the cross-lighting path 90. The hollows or cavities 80 in the partitions or walls 64 serve to limit the conduction of heat from the lower wall portion 72 through the intermediate wall portion 74 into the upper wall portion 70, and therefore, convection of heat through the surface 71 into the air/gas mixture passing through the converging inlet portion 84 of the slot 66. The purpose of such a limitation is to prevent the surface 71 attaining a temperature sufficiently high to ignite the air/gas mixture in the inlet portion 84.

The efficiency of the burner is optimized by designing the slotted flamestrip in accordance with the following parameters:

$$\frac{\text{Length of constant dimension slot portion } (L)}{\text{Width of constant dimension slot portion } (w)} \geqq 10$$

$$\frac{\text{Pitch of the slots through the burner flamestrip } (P)}{\text{Width of constant dimension slot portion } (w)} \geqq 2$$

Length of the constant dimension slot portion (L)≧Length of converging inlet portion (l).

By way of illustration only, a typical slotted ceramic burner flamestrip has the following dimensions :

L=10 mm

W=4 mm

P=5 mm w=0.5 mm l=5 mm

Applicants investigations have shown that under enclosure and firing conditions in which premixed combustion would normally produce resonant noise, an arrangement using a burner as described above with twenty slots 66 each having a dimension of 40 mm between the walls 52,54 together with a closely positioned porous plate has been free from resonant noise at all rates of heat input in the range from 1 kilowatt to 5.5 kilowatts.

While a particular embodiment of the invention has been described above, various modifications or improvements may be made. For example, the diverging outlet portions 88 may be omitted so that the lower end of each slot 66 (having regard to the views shown in FIGS. 1 and 2) terminates at the bottom end 86*a* of the constant dimension slot portion 86.

Figure 4:
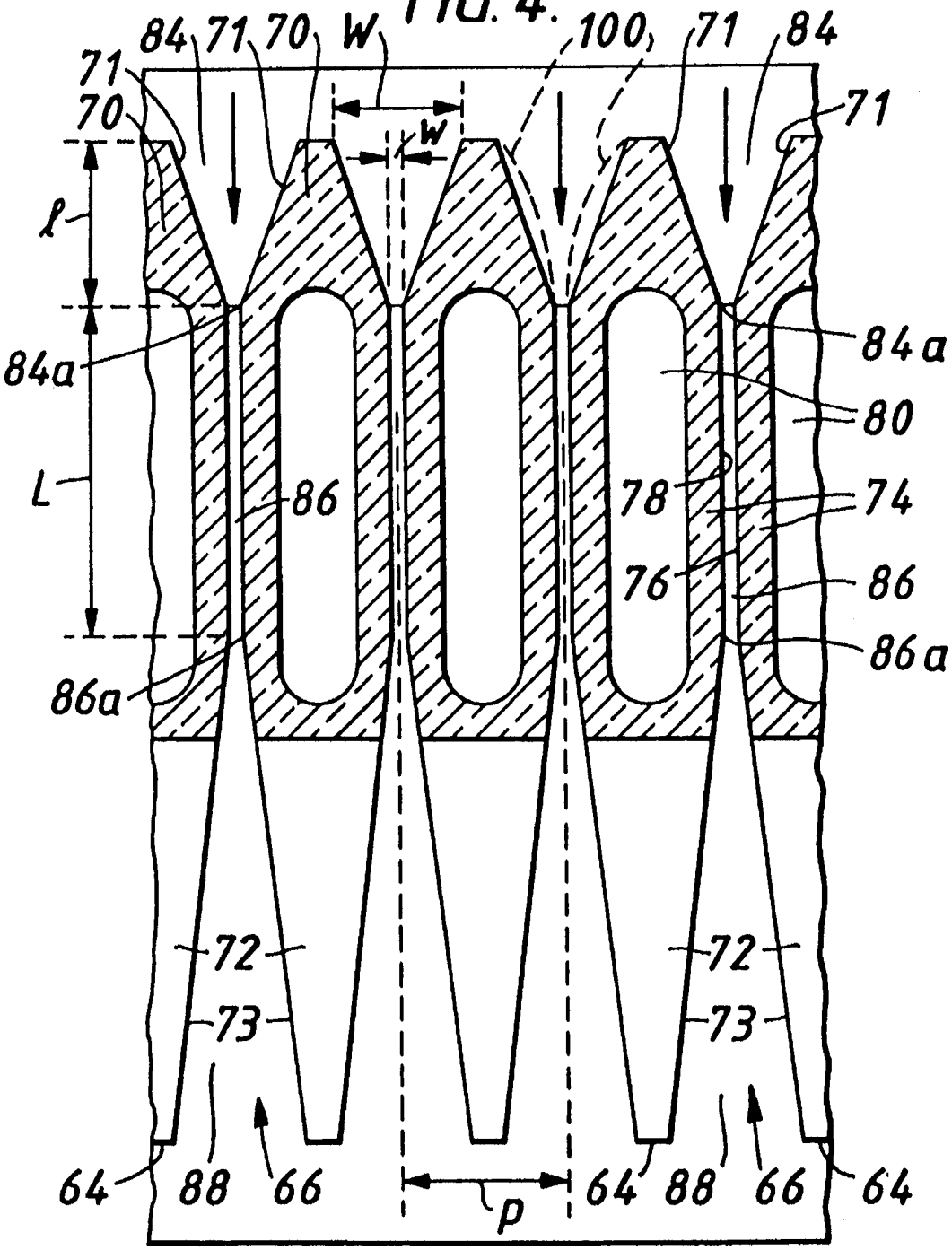
FIG. 4 is a sectional view on an enlarged scale of the slotted wall as shown in FIG. 2.

Also, the converging inlet portions 84 need not be defined between tapered walls 70 having straight or flat sides 71, but may have a varying angle of convergence with the tapered walls having sides of convex elliptical form as illustrated diagrammatically by the dotted lines 100 in FIG. 4.

Obviously, numerous modifications and variations of the present invention are possible in light of the above teachings. It is therefore to be understood that within the scope of the appended claims, the invention may be practiced otherwise than as specifically described herein.

I claim:

1. A fuel fired burner, comprising:

a chamber for receiving a premixture of fuel and air, a wall of the chamber being provided with a plurality of elongate slots extending through the wall, each slot having an inlet portion which converges to an end leading to a substantially constant dimension portion wherein the pitch of the slots along the chamber wall is P, a width dimension of each slot is w, and the length of the constant dimension portion is L; and wherein $L/w \geqq 10$ and $P/w \geqq 2$; and an acoustic baffle located upstream of and close to inlet portions of the slots so as to minimize the volume of the space between a downstream side of the acoustic baffle and the inlet portions and increase resistance of the burner to generation of resonant combustion noise.

2. A burner as claimed in claim 1, wherein a length dimension of the inlet portion is l, and wherein $L \geqq l$.

3. A burner as claimed in claim 1, wherein each converging inlet portion has a varying angle of convergence.

4. A burner as claimed in claim 3, wherein each side wall of the converging inlet portion has a convex elliptical curvature.

5. A burner as claimed in claim 1, wherein each slot also has an outlet portion which diverges from an end of the constant dimension portion remote from the inlet portion.

6. A burner as claimed in claim 1 or claim 2 wherein the baffle comprises a distribution plate distributing a fuel gas/air mixture uniformly and at a low intensity of flow turbulence to the slots.

7. A fuel fired burner, comprising:

a chamber receiving a premixture of fuel and air, a wall of the chamber being provided with a plurality of elongate slots extending through the wall, each slot having an inlet portion which converges to an end leading to a substantially constant dimension portion wherein a pitch of the slots along the chamber wall is P, a width dimension of each slot is w, and a length dimension of the constant dimension portion is L; and wherein $L/w \geqq 10$ and $P/w \geqq 2$ and wherein portions of a wall on each side of the slots are provided with aligned recesses so as to form a cross-lighting path across the burner.

8. A fuel fired burner, comprising:

a chamber receiving a premixture of fuel and air, a wall of the chamber being provided with a plurality of elongate slots extending through the wall, each slot having an inlet portion which converges to an end leading to a substantially constant dimension portion wherein a pitch of the slots along the chamber wall is P, a width dimension of each slot is w, and a length dimension of the constant dimension portion is L; and $L/w \geqq 10$ and $P/w \geqq 2$ and wherein one of hollows and cavities is provided within wall portions on each side of the slots.

* * * * *